US006380847B1

(12) United States Patent
Bremond et al.

(10) Patent No.: US 6,380,847 B1
(45) **Date of Patent: *Apr. 30, 2002**

(54) CONTROL CIRCUIT FOR A VIBRATING MEMBRANE

(75) Inventors: André Bremond, Veretz; Philippe Merceron, Vernon, both of (FR)

(73) Assignee: SGS-Thomson Microelectronics S.A., Gentilly (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/082,926

(22) Filed: May 21, 1998

(30) Foreign Application Priority Data

May 22, 1997 (FR) ..... 97 06497

(51) Int. Cl.[7] ..... G08B 3/00

(52) U.S. Cl. ..... 340/388.3; 340/388.1; 340/384.1

(58) Field of Search ..... 340/388.3, 384.1, 340/388.1

(56) References Cited

U.S. PATENT DOCUMENTS 3,283,299 A * 11/1966 Savino ..... 340/396
3,582,687 A * 6/1971 Bellomo ..... 307/279
3,797,013 A * 3/1974 Flaig et al. ..... 340/396
4,136,337 A 1/1979 Larime ..... 340/384 R
4,598,049 A * 7/1986 Zelinka et al. ..... 435/287
4,747,351 A * 5/1988 Baret ..... 104/297
5,200,530 A 4/1993 Dahl et al. ..... 549/214
5,457,437 A 10/1995 Kim ..... 340/384.1

OTHER PUBLICATIONS

The definition of SCR and circuit for overvoltage protection, Feb. 1997.*

Electronic circuits Manual by John Markus 1971 the first figure on top, 1971.*

French Search Report from French Patent Application No. 97 06497, filed May 22, 1997.

* cited by examiner

*Primary Examiner*—Nina Tong
(74) *Attorney, Agent, or Firm*—Wolf, Greenfield & Sacks, P.C.; James H. Morris; Robert A. Skrivanek, Jr.

(57) ABSTRACT

The present invention relates to a control circuit of a vibrating membrane excited by a solenoid in series with a d.c. supply and a controlled switch. A capacitor is disposed across a series circuit including the solenoid and the switch associated with opening means in the vicinity of a zero crossing of the current in the inductance.

4 Claims, 2 Drawing Sheets

CONTROL CIRCUIT FOR A VIBRATING MEMBRANE

BACKGROUND OF THE INVENTION

1. Field of the Invention

The present invention relates to control circuits for a vibrating membrane used in particular as a car horn or as an alarm device.

2. Discussion of the Related Art

FIG. 1 shows a conventional circuit for control of a vibrating membrane. A membrane 17 is placed with respect to a solenoid S to be attracted by this solenoid when it generates an excitation field. The solenoid is disposed in a series circuit including a d.c. power supply E, for example, a car battery, a turn-on switch P, and a circuit breaker B which opens when membrane 17 reaches an extension corresponding, for example, to the membrane position shown in dotted lines and designated as 17'. Turn-on switch P is for example a push-button switch or a switch controlled by an external circuit such as a defect detection circuit for triggering an alarm. The operation of this circuit is the following. In the initial state, circuit breaker B is closed and, as soon as push-button P is actuated, a current flows through solenoid S and attracts the membrane to its position 17'. When the membrane is in position 17', circuit breaker B opens and the membrane returns to its idle position 17. This is repeated as long as switch P remains closed.

This circuit has the disadvantage that the opening of circuit breaker B occurs when the current in the solenoid is maximum. Such an abrupt opening of a circuit generates cut-off pulses and parasitic radiofrequency signals which can have an adverse effect on circuits linked to the vibrator circuit or neighbor thereto, for example, other electronic circuits of an automobile. Also, in the case of an alarm circuit, if source E corresponds to a rectified supply source, the parasitic signals can reach the main power supply.

SUMMARY OF THE INVENTION

The present invention aims at overcoming these disadvantages and at providing a vibrator control circuit generating next to no parasitic signals.

To achieve these and other objects, the present invention provides a control circuit for a vibrating membrane excited by a solenoid in series with a d.c. supply and a controlled switch, comprising a capacitor disposed across a series circuit including the solenoid and the switch; and means for opening the switch in the vicinity of a zero crossing of the current in the inductance.

According to an embodiment of the present invention, the controlled switch is formed of a thyristor disposed between the first terminal of the capacitor and the first terminal of the solenoid, the gate of the thyristor being connected to the first terminal of the capacitor by a zener diode and the gate of the thyristor being connected to its cathode via a resistor, the thyristor intrinsically forming the opening means in the vicinity of a zero crossing of the current.

According to an embodiment of the present invention, the circuit further includes a resistor in series between the supply and the capacitor to set the charge time constant thereof.

The foregoing objects, characteristics and advantages of the present invention will be discussed in detail in the following non-limiting description of specific embodiments, in connection with the accompanying drawings.

DETAILED DESCRIPTION

In the present invention, the exciter solenoid of a vibrating membrane is inserted in a resonant circuit to obtain an oscillating current in this solenoid, that is, a current which increases and then transits through zero. Then, the present invention provides to interrupt the supply of the solenoid at the time when the current therein reaches a zero value. Since this circuit opening occurs for a zero current, no parasitic signals will be generated.

Figure 1:
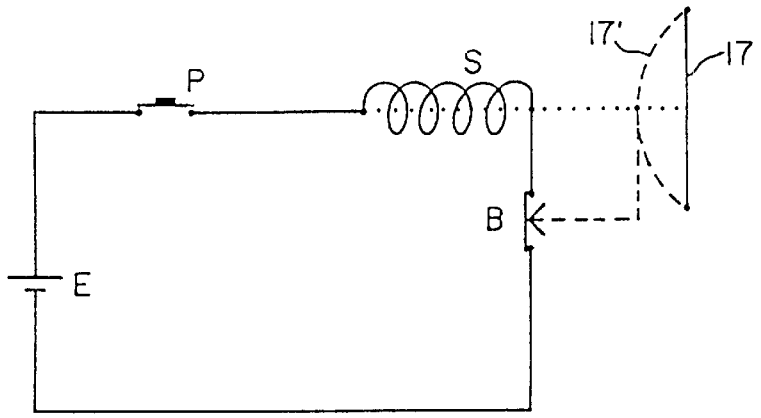
FIG. 1 (PRIOR ART)
FIG. 1 previously described shows a conventional vibrator control circuit.
Figure 2:
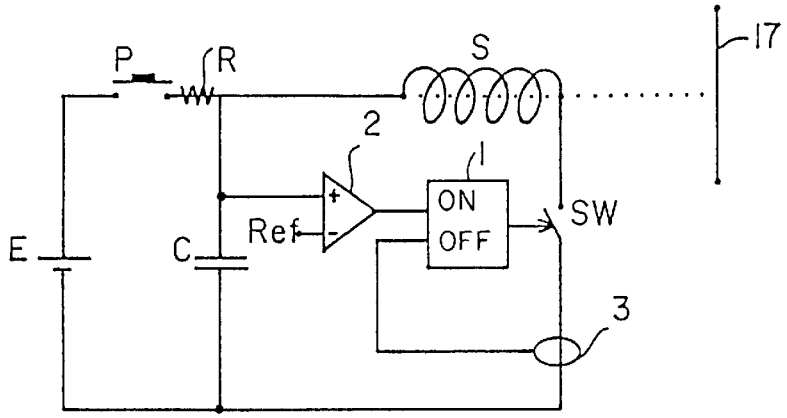
FIG. 2 shows a block diagram of a vibrator control circuit according to the present invention.

FIG. 2 shows a block diagram illustrating the general operation of a circuit according to the present invention.

As previously, a solenoid S is placed in a series circuit comprising a supply source E, a switch P, and a switch SW. Further, the circuit includes a capacitor C disposed across the series circuit including the solenoid and switch SW. Preferably, a resistor R is placed in series in the circuit including supply source E, switch P, and capacitor C. Switch SW is controlled by a control circuit 1 which ensures the closing of switch SW when it receives, on an input ON, the indication that the voltage on capacitor C exceeds a determined threshold. This has been schematically shown by the use of a comparator 2 receiving on its (+) input the voltage across capacitor C and on its (−) input a reference voltage REF. Switch SW is opened when control circuit 1 receives on a second input OFF an indication of the fact that the current in this solenoid, detected by a detector 3, reaches a substantially null value.

The operation of this circuit is the following.

As soon as push-button P is pressed, capacitor C charges and when it reaches a voltage slightly lower than the value of the voltage of supply source E, determined by reference value REF, control circuit 1 closes switch SW. The loop comprising capacitor C and solenoid S then operates as an oscillating circuit. The current increases rapidly, then decreases while membrane M is attracted. As soon as the current in solenoid S reaches a substantially null value, switch SW is opened. The cycle is repeated as long as switch P remains closed.

Further, the present invention provides particularly simple practical implementations of the circuit of FIG. 2.

Figure 3:
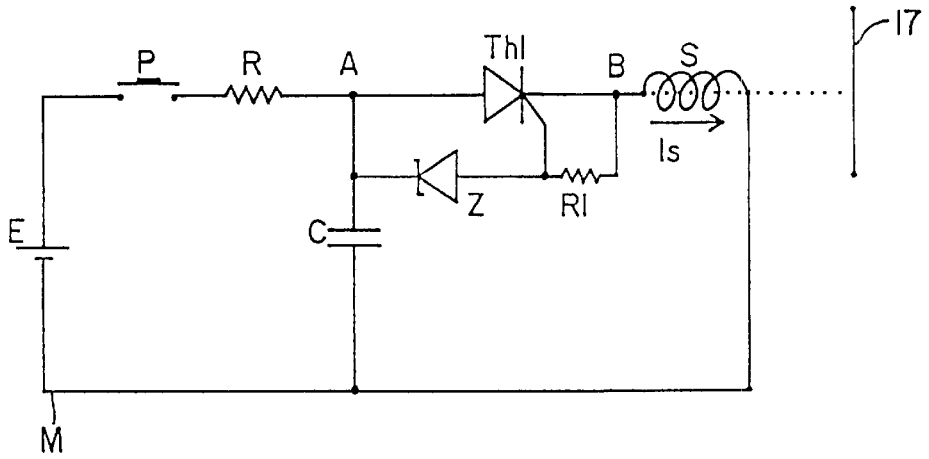
FIG. 3 shows an embodiment of the present invention.

An embodiment is illustrated in FIG. 3. In this embodiment, a thyristor Th1 is connected between a first terminal A of capacitor C and a first terminal B of solenoid S. A zener diode Z is connected between the gate of thyristor Th1 and the first terminal of capacitor C and a resistor R1 is connected between gate and cathode of thyristor Th1.

In this circuit, as soon as switch P is closed, capacitor C charges with a time constant determined by the value of resistor R. When the voltage across capacitor C exceeds the value of the avalanche voltage of zener diode Z (chosen to be slightly lower than E), thyristor Th1 turns on and a current flows in the oscillating loop comprising capacitor C and solenoid S. As soon as this current transits through zero, thyristor Th1 automatically opens and the cycle is repeated as long as push-button P remains closed. An advantage of this embodiment is the fact that thyristor Th1 ensures the double function of switch and zero crossing detector.

Figure 4:
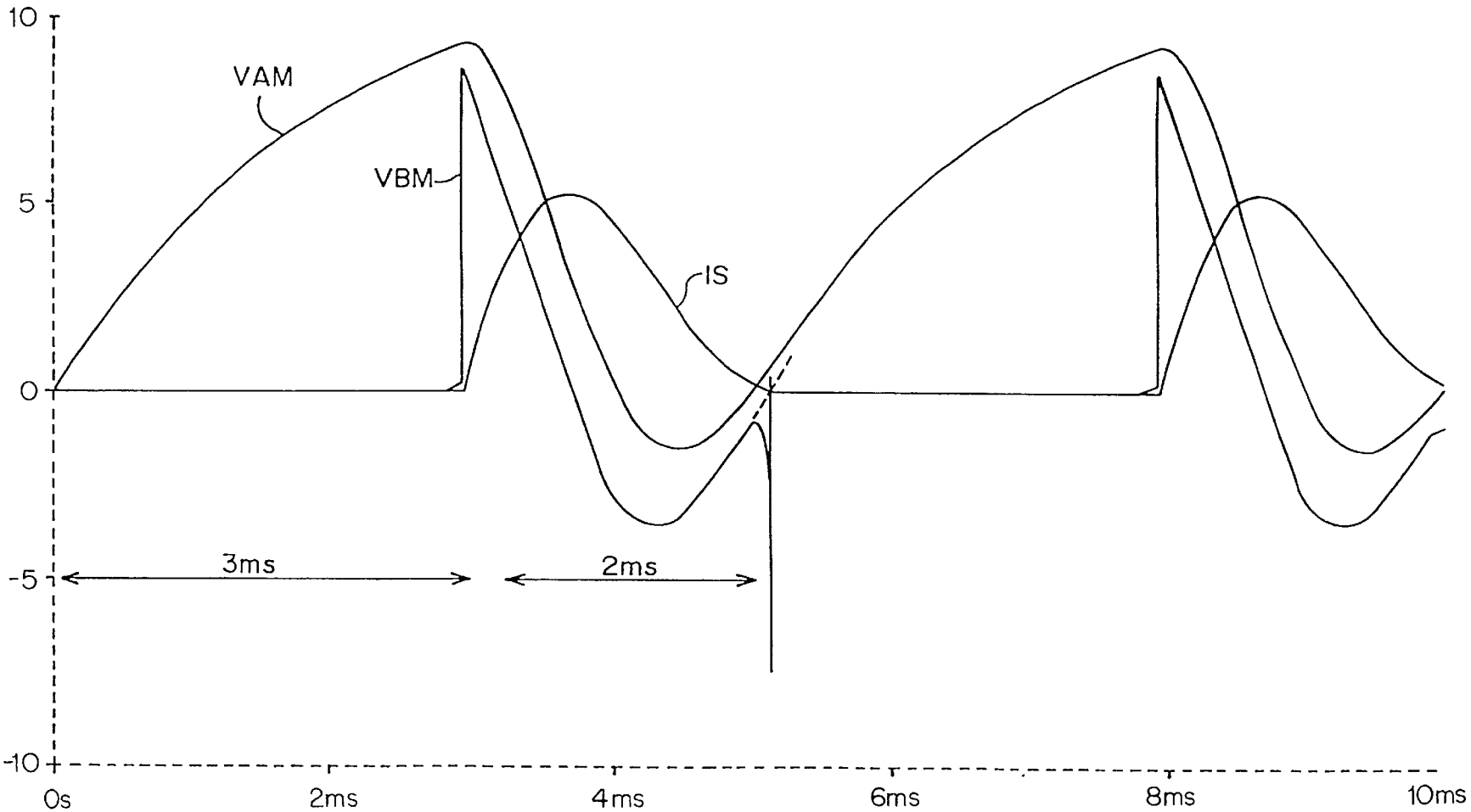
FIG. 4 shows voltage and current curves corresponding to the circuit of FIG. 3.

FIG. 4 illustrates the shape of various currents and voltages of the circuit of FIG. 3. The first terminal of the capacitor is referred to as A, the first terminal of the solenoid is referred to as B, and the common node of the second terminals of the switch and of the solenoid is referred to as M. Thus, FIG. 4 more specifically shows voltages $V_{AM}$, $V_{BM}$, and current $I_S$ in the solenoid. This drawing has been drawn for:

R=6.2 ohms,

R1=300 ohms,

E=12 volts,

C=330 microfarads,

L=0.6 millihenry, zener diode Z having an avalanche voltage substantially equal to 9 volts.

As shown in FIG. 4, voltage $V_{AM}$ across capacitor C increases to 9 volts in approximately 3 milliseconds. At this time, voltage $V_{BM}$ across the solenoid abruptly increases and current $I_S$ therein transits through successive phases of increase and decrease to reach a zero value after substantially 2 milliseconds. The cycle is then repeated periodically.

Of course, the present invention is likely to have various alterations, modifications, and improvements which will readily occur to those skilled in the art. Especially, the operating cycle of the vibrator can be modified by modifying the value of resistor R and the relative values of the capacitor C capacitance and the solenoid inductance to obtain a desired tone. Further, in the embodiment of FIG. 3, any threshold device other than a simple zener diode can be used.

Such alterations, modifications, and improvements are intended to be part of this disclosure, and are intended to be within the spirit and the scope of the present invention. Accordingly, the foregoing description is by way of example only and is not intended to be limiting. The present invention is limited only as defined in the following claims and the equivalents thereto.

What is claimed is:

1. A circuit for a vibrating membrane excited by a solenoid in series with a d.c. power supply and a control switch, comprising:

a capacitor disposed across a series circuit including the solenoid and the control switch; and means for opening the control switch in a vicinity of a zero crossing of a current in the solenoid;

wherein the control switch includes a thyristor disposed between a first terminal of the capacitor and a first terminal of the solenoid, a gate of the thyristor being connected to the first terminal of the capacitor by a zener diode and the gate of the thyristor being connected to a cathode of the thyristor via a resistor, the thyristor intrinsically forming the opening means in the vicinity of the zero crossing of the current.

2. The circuit of claim 1, further including a resistor in series between the power supply and the capacitor to set a charge time constant thereof.

3. The circuit of claim 1, wherein a resistance of the resistor, a capacitance of the capacitor, and an inductance of the solenoid control a frequency of oscillation of the circuit.

4. A circuit for a vibrating membrane excited by a solenoid in series with a d.c. power supply and a control switch, comprising:

a capacitor disposed across a series circuit including the solenoid and the control switch; and means for opening the control switch in a vicinity of a zero crossing of a current in the solenoid;

wherein the control switch includes a thyristor disposed between a first terminal of the capacitor and a first terminal of the solenoid, the gate of the thyristor being connected to the first terminal of the capacitor by a threshold device, and the gate of the thyristor being connected to a cathode of the thyristor via a resistor, the thyristor intrinsically forming the opening means in the vicinity of the zero crossing of the current.

* * * * *